United States Patent [19]

Skinn et al.

[11] Patent Number: 4,909,126

[45] Date of Patent: Mar. 20, 1990

[54] AUTOMATIC MUSICAL INSTRUMENT TUNING SYSTEM

[75] Inventors: Neil C. Skinn; Stephen J. Freeland, both of Fort Collins, Colo.

[73] Assignee: TransPerformance, Inc., Fort Collins, Colo.

[21] Appl. No.: 296,494

[22] Filed: Jan. 12, 1989

Related U.S. Application Data

[63] Continuation-in-part of Ser. No. 128,685, Dec. 4, 1987, Pat. No. 4,803,908.

[51] Int. Cl.[4] ..... G10G 7/02

[52] U.S. Cl. ..... 84/454; 84/DIG. 18

[58] Field of Search ..... 84/454, 455, DIG. 18

[56] References Cited

U.S. PATENT DOCUMENTS

| | | | |
|---|---|---|---|
| 3,144,802 | 8/1964 | Faber | 84/454 |
| 4,044,239 | 8/1977 | Shimauchi | 84/DIG. 18 X |
| 4,088,052 | 5/1978 | Hedrick | 84/454 |
| 4,196,652 | 4/1980 | Raskin | 84/454 X |
| 4,207,791 | 6/1980 | Murakami | 84/454 X |
| 4,313,361 | 2/1982 | Deutsch | 84/454 X |
| 4,327,623 | 5/1982 | Mochida et al. | 84/454 X |
| 4,426,907 | 1/1984 | Scholz | 84/454 |
| 4,584,923 | 4/1986 | Minnick | 84/454 |
| 4,732,071 | 3/1988 | Deutsch | 84/454 |

*Primary Examiner*—W. B. Perkey

*Attorney, Agent, or Firm*—Dean P. Edmundson

[57] ABSTRACT

A tuning system is described for automatically tuning a musical instrument having adjustment means for changing the frequency of a musical tone produced by the instrument. The tuning system is useful with respect to a wide variety of musical instruments, e.g., stringed instruments such as guitars, harps, pianoes, etc.; horns; and other instruments. The tuning system is capable of automatically tuning all strings of a stringed instrument simultaneously.

18 Claims, 5 Drawing Sheets

AUTOMATIC MUSICAL INSTRUMENT TUNING SYSTEM

CROSS-REFERENCE TO RELATED APPLICATIONS

This application is a continuation-in-part of our copending application Ser. No. 07/128,685 filed Dec. 4, 1987, now U.S. Pat. No. 4,803,908.

FIELD OF THE INVENTION

This invention relates to tuning of musical instruments. More particularly, this invention relates to techniques for automatically tuning musical instruments. In another aspect, this invention relates to techniques and systems for automatically tuning stringed musical instruments.

BACKGROUND OF THE INVENTION

Tuning of musical instruments is a difficult and tedious yet very necessary procedure for musicians. This is especially true when two or more instruments must be tuned to play at the same time. For example, musicians in an orchestra or a band must have their instruments in tune with each other, and tuned properly, before they can play music together. An even larger complication arises when the musicians or artists attempt to change to and from keys having different base interval relationships.

At times a group of musicians will start playing a song only to realize that one of the group needs to tune his or her instrument. Then a decision must be made to either continue playing out of tune or to stop, tune the instrument, and re-start. If this happens in front of an audience it can be very embarrassing. Of course, there is no guarantee that the state of tune will be any better following re-tuning. Furthermore, the time lost in re-tuning can be irritating to everyone.

Some musical instruments can be tuned in a number of ways. For example, the guitar has many different "open tunings" and "modal tunings", each of which has special advantages for playing certain songs. The performer usually does not want to retune during a performance so he brings to the stage a guitar for each tuning he will use. Each such guitar must be separately tuned and must be maintained in that condition up to the time it is played. For several different tunings, this procedure necessitates having several different guitars. This can be quite costly, and it also requires the performer to take the time to change guitars during a performance.

Furthermore, stringed instruments can change enough during a performance to go out of tune. This may be caused by a variety of factors such as humidity, temperature, and continued stress on the strings during playing.

Some musicians are better than others in tuning an instrument. As a result, some musicians are able to tune an instrument correctly in a reasonable period of time, while others (e.g. inexperienced musicians) may require a long period of time to tune and may not be entirely accurate in doing so.

Although there has been previously proposed a tuning apparatus (see, for example, U.S. Pat. No. 4,088,052) to detect the pitch in a stringed instrument electronically, such apparatus is not capable of automatically tuning the instrument. Furthermore, such apparatus can only tune one string at a time. There is also the possibility of error introduced by the mechanical portion of the system. Moreover, the apparatus uses analog filtering which has inherent limitations.

It is also necessary for the string being tuned to be vibrating during the entire tuning process. Another limitation of this apparatus is that it cannot compensate for the effects of neck warpage etc. during tuning of a guitar, for example.

Other types of tuning devices and tuning apparatus are disclosed in the following patents: U.S. Pat. No. 4,196,652 (Raskin); U.S. Pat. No. 4,207,791 (Murakami); U.S. Pat. No. 4,313,361 (Deutsch); U.S. Pat. No. 4,327,623 (Mochida); U.S. Pat. No. 4,426,907 (Scholz); U.S. Pat. No. 4,584,923 (Minnick); U.S. Pat. No. 3,144,802 (Faber); U.S. Pat. No. 4,044,239 (Shimauchi); and U.S. Pat. No. 4,732,071 (Deutsch).

Each of the prior devices and apparatus exhibit various disadvantages and limitations, however. The primary disadvantage of the prior tuning devices is that they utilize analog filtering of interfering signals to determine the frequencies generated by the instrument. This is not very precise. Furthermore, in an analog system the frequencies must be excited during the entire tuning process.

All of these prior devices are relatively slow in tuning. A device which tunes one string at a time must iterate several times to compensate for non-linear components. Also, none of such devices provide for friction in the nut or bridge. Locations of friction in a guitar or the like are the bridge and/or nut and the tuning peg mechanism. At the bridge or nut a string will move in short spurts due to differences between the coefficients of static and kinetic friction. That is, once a string begins to move it moves further than desired during tuning. The tuning peg mechanism involves considerable friction.

Further, none of the prior devices provide compensation for non-linear effects in stringed instruments. Non-linear effects include factors such as temperature changes and neck warpage. Nor do any of the prior devices have versatility which enables expansion for interfacing several instruments simultaneously.

For example, several of such devices are only capable of tuning one string at a time. Other devices have inadequate visual readout. Some devices do not relate to tuning of stringed instruments. Some of the devices are only capable of tuning to equal temperament, and some are only capable of tuning to predetermined frequencies with no variation possible. Also, the possibility of human error still exists with respect to the use of certain devices.

Certain of the devices are capable of tuning a string only when the string is vibrating with enough amplitude to fall into the constraints of the electronic components included in the device. If the amplitude of the signal is not great enough to enable the electronics involved, then the string cannot be tuned at all until the string is re-excited.

Further, certain of the devices use inadequate filtering techniques. Analog filters introduce phase errors into the filtered frequency. When the reference frequency is compared to the filtered frequency errors can occur because there is a phase difference in the two signals.

In yet another respect, some of the devices are mechanically complex and therefore are expensive and prone to unreliability due to mechanical failure and other causes.

One of the prior devices senses string tension as a means for changing the frequency. This technique has several inherent disadvantages. The number of vibrations per second is inversely proportional to the length of the string and the thickness of the string. It is also proportional to the square root of the tension to which the string is subjected. Finally, the number of vibrations is inversely proportional to the square root of the density of the string. The thickness or cross-sectional area of the string changes in character chiefly due to the stress on the string during playing. Because of the changes in the cross-sectional area the frequency is not in a perfectly linear relation to the tension. Consequently, the method of sensing tension is inferior.

None of the prior tuning devices or apparatus provide the advantages exhibited by the system and techniques of the present invention.

SUMMARY OF THE INVENTION

In accordance with the present invention there is provided a system for automatically tuning a musical instrument having adjustment means for changing the frequency of a musical tone produced by the instrument. The system comprises:

(a) a detection means adapted to detect a musical tone produced by said instrument and produce a signal;
(b) converter means adapted to convert said signal to a digital signal;
(c) processing means adapted to convert said digital signal to a frequency signal;
(d) comparator means for comparing said frequency signal to a predetermined frequency value and producing an electrical signal;
(e) tension adjustment means comprising a pivotable tune lever arm means connected to the string for adjusting the tension on the string;
(f) motor means activated by said electrical signal; wherein said motor means is operably connected to said adjustment means for adjusting said frequency to correspond with said predetermined value;
(g) biasing means connected to the tension adjustment means for providing a bias force in opposition to the force on the tension adjustment means by the string; and
(h) optionally, calibration means for computing the relationship between the frequency signal, the tension on the string, and the position of the motor.

The system includes compensating means for correcting for non-linear effects of the instrument, such as warpage, temperature, and humidity. The compensating means can also correct for linear effects.

The tuning system of the invention is useful in connection with a wide variety of musical instruments, including stringed and non-stringed instruments. For example, it is useful for tuning guitars, harps, pianos, horns, etc.

The tuning system is capable of automatically tuning all strings of an instrument simultaneously in a rapid and efficient manner. Prior tuning systems have not provided this capability.

The present invention also provides an improved mechanical system for adjusting the tension of a string in a stringed instrument. This system in one embodiment includes a spring or other bias means for balancing or reducing the load on a tune arm to which the motor is connected so as to reduce the load on the motor. This allows smaller motors to be used in the system, and thrust bearings are not required. It also simplifies the design of the moment arms.

The system of the present invention also enables all strings in a multi-stringed instrument to lie in a single plane.

Other advantages of the system of this invention will be apparent from the following detailed description and the accompanying drawings.

BRIEF DESCRIPTION OF THE DRAWINGS

The invention is described in more detail hereinafter with reference to the accompanying drawings, wherein like reference characters refer to the same parts throughout the several views and in which.

DETAILED DESCRIPTION OF THE INVENTION

Tuning of an instrument such as a stringed instrument involves tightening each string so that it exhibits a particular frequency signal when in motion. The exact frequency which is desired to be produced or generated by each string is dependent upon the type of tuning performed. For example, an instrument can be tuned to a "true" scale or a "tempered" scale. The frequency intervals between each string on each of these different scales are different but are nevertheless related to each other by specific ratios.

When an instrument is not in proper tune, it means that one or more of the strings is not vibrating at the proper or intended frequency. The ratios between the fundamental frequencies on the true scale are supposed to be small whole numbers. Whenever one or more of the strings is out of proper tune the resulting sound of the instrument may be referred to as dissonant. This is very displeasing, especially if the strings are significantly out of tune.

If the automatic tuning system of this invention the frequencies generated by the instrument in a state of open tune, for example, are sampled and determined. Then, using a table or relationship of the correct frequencies for the instrument, an error for each frequency generated by the instrument is determined. The error signal is applied to an electromechanical system which then brings each string to a new state of tuning. For non-stringed instruments the electromechanical system may move a slide, for example, to change the frequency.

The process of sampling the frequencies generated by the instrument may be repeated as often as needed to allow compensating means to correct for linear and non-linear effects. The compensating means comprises a computer algorithm which is updated during each sampling regarding any linear or non-linear behavior of the instrument during tuning. Following complete algorithm updating, any different predetermined state of tuning may be achieved by requesting the electromechanical system to alter the frequencies of the strings. Virtually any parameter which effects the state of tuning of a musical instrument can be included in the computer based state equation for the instrument. As an example, the effect of temperature change during long outdoor performances can be determined and used in the tuning system. The system of the invention can be used not only for open tuning, but also for tempered, true or modal tuning.

The system being described herein may be applied to many musical instruments.

Figure 1:
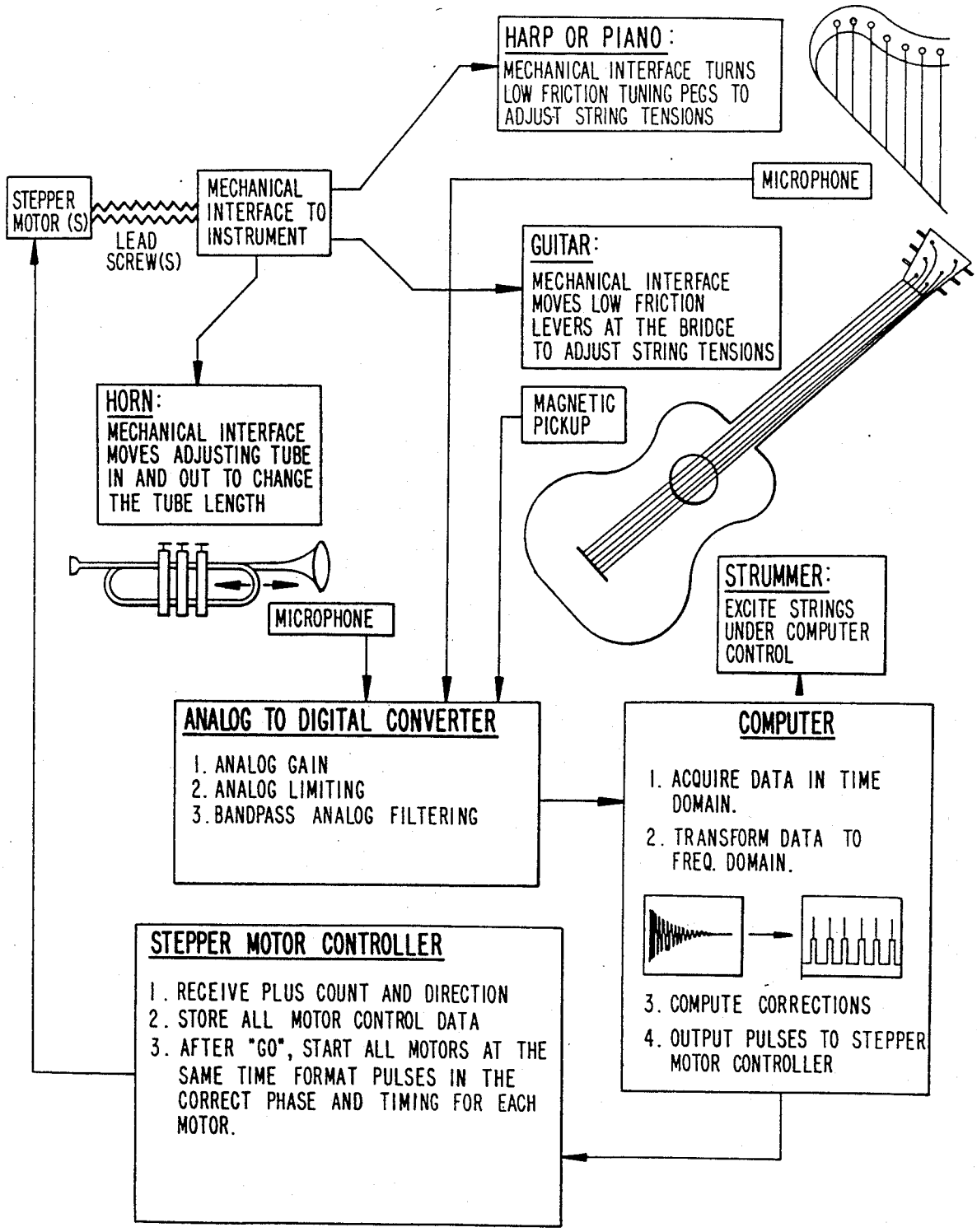
FIG. 1 is a block diagram illustrating the tuning system of the present invention.

FIG. 1 is a block diagram illustrating the automatic tuning system of this invention. As one example, the tuning system may be used in connection with a stringed instrument such as a guitar. Once the strings are excited one or more transducers (such as magnetic pickups), detect musical tones produced by the guitar and produce signals which are converted to digital signals by a conventional analog-to-digital converter. Then the digital signals are transferred to a computer which processes the signals using a time-to-frequency domain transformation algorithm, such as periodicity determination in the time domain or a Fourier transform (FT), for example, to convert the signals to frequency signals. Then the computer compares the frequency signals to predetermined frequency values or uses the computer algorithm to produce corresponding electrical signals. Then each electrical signal activates a motor (e.g., a stepper motor) which is operably connected to adjustment means for adjusting the frequency of the corresponding string to correspond with the predetermined value. The tuning system is capable of tuning all strings of a stringed instrument simultaneously.

As an example of a typical application, the details of a system for guitar will be given where appropriate. The system will automatically adjust the frequency of a vibrating string on a musical instrument by changing the tension of the string using data gathered from a transducer coupled to the instrument. The system can be further adapted to adjust the frequency or frequencies of any musical device where there exists:

(1) a suitable means of transducing those frequencies for computer analysis, and (2) a suitable means of transducing the results of the computer analysis to adjust the frequency or frequencies of the musical device.

Thus, the tuning system of the invention can also be used in connection with other instruments such as a horn, or a harp, or a piano, for example. This is also illustrated in the schematic of FIG. 1. For example, a horn can include a slide mechanism which allows for changing of the frequency of a musical tone produced by the horn. Also, the tuning instrument may be used in connection with a harp or piano.

Various types of detection means may be used to detect the musical tone produced by a musical instrument and produce a corresponding analog signal. For example, any conventional transducer may be used. Thus, there may be used a magnetic pickup for some types of instruments; a microphone; a piezoelectric pickup; optical means; etc. These types of transducers are all useful in certain situations.

The system is described hereinafter with reference to the automatic tuning of a six string electric guitar.

DATA ACQUISITION

Figure 6:
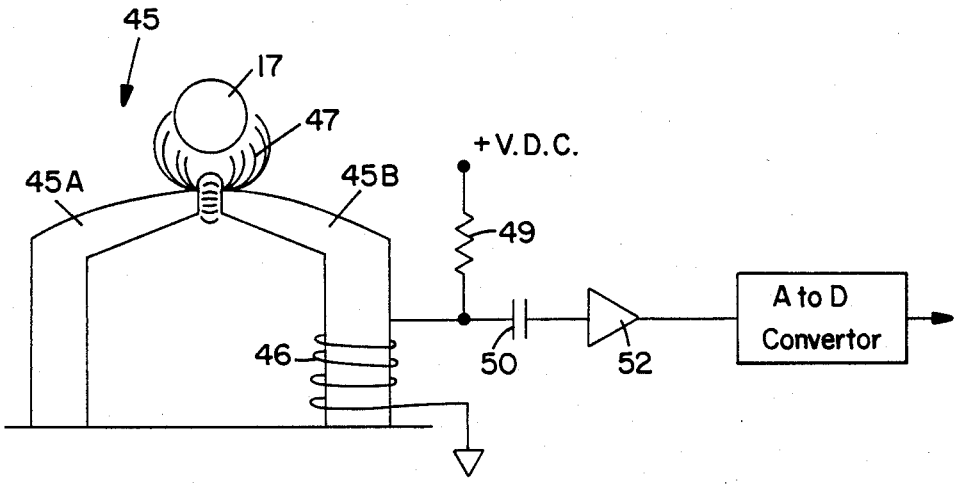
FIG. 6 is an end view illustrating a preferred type of transducer which is useful in the present invention to detect a musical tone produced by a string.

The signals from the six magnetic pickups 45 (shown in FIGS. 2, 3 and 6), each of which is adjusted so as to transduce the signal from a respective string 17 of the guitar, are fed to an analog to digital convertor (ADC). As shown in FIG. 6, each pickup 45 includes magnetic pole sections or members 45A and 45B (e.g., of a conventional magnetic tape head) used in a novel configuration. The electric coil 46 encircles one of the pole sections and is energized with a positive D.C. voltage, thereby producing a static magnetic field 47 across and in the near vicinity of the gap between the pole sections, as illustrated. As the string 17 vibrates it cuts the lines of force 47, thereby producing a signal in the coil which is amplified by an AC amplifier 52 coupled to the electric coil through a capacitor 50. This arrangement exhibits a degree of selectivity for individual string signals while more than one string is vibrating which is superior to a normal six coil magnetic pickup. The amplified signal is then fed to the analong-to-digital convertor, as illustrated. The signal must be amplified and filtered between the magnetic pickup and the ADC with the following general requirements:

(1) the signals must be between half and full scale on the ADC during acquisition, and, (2) frequencies greater than the fundamental frequency of each string be effectively attenuated.

Special limiting circuitry may be used if necessary, to provide a signal of the proper amplification. Filtering is required to remove harmonics and upper partials which produce unwanted (a) "alias" frequencies according to the Nyquist sampling theorem, and (b) difference frequencies which appear in the desired spectrum of the guitar. Filtering of 12 to 24 db per octave rolloff starting at a point 10% above a strings's frequency will be adequate.

The data will be acquired starting shortly after all the strings have been set in motion with a "strum". Each string's signal will be acquired until a preset number of points have been read with no points exceeding a preset threshold. Each string's threshold can be different. In this way, differences in string amplitude due to unequal strumming are removed. This also allows acquisition of string signals at different times following the strum according to each string's relaxation. While the smaller strings tend to relax quickly producing stable frequencies shortly after a strum, the larger strings require longer relaxation before frequency stability is achieved.

To encompass an acquisition window 10% greater than the highest frequency possible, 392 Hz+39 Hz=431 Hz is required. To define a sinusoidal wave, a minimum of two points per cycle must be acquired (Nyquist sampling theorum). Doubling 431 Hz to 862 points/second gives a data acquisition rate of 1.16 milliseconds/point. An acquisition data array of 512 points requiring just over 0.5 seconds is adequate.

COMPUTER ANALYSIS

After the data has been acquired, a transformation is performed by the computer (either contained within the guitar or existing as an outboard computer) shifting the data from the time domain (in which it was acquired) to the frequency domain. By transforming the time domain data into the frequency domain, the frequency data for each string emerges from that of the others in such a way that the computer can easily determine the frequency of each string. The transformation is called the fast Fourier transform (FFT) developed by Cooley and Tukey in 1965. The analysis of the frequency data will require an array of at least 4096 points giving a resolution of at least 431 Hz/4096 points=0.105 Hz/point. To achieve this array size, the 512 data points acquired may be "zero filled " out to 4096. This adds no new information to the data. The result is that more points define the "peaks" for each string making the frequency determination process more precise.

Following the FFT, the computer determines the frequency of each string, compares this value with the currently requested value for that string, and determines the correction, if any, to be applied. Alternatively, the correction can come from a system of equations determined by the computer during an earlier calibration of the instrument. This calibration can be performed by the computer which computes the relationship between the frequency signal and the tension on the string, and the position of the motor.

Figure 2:
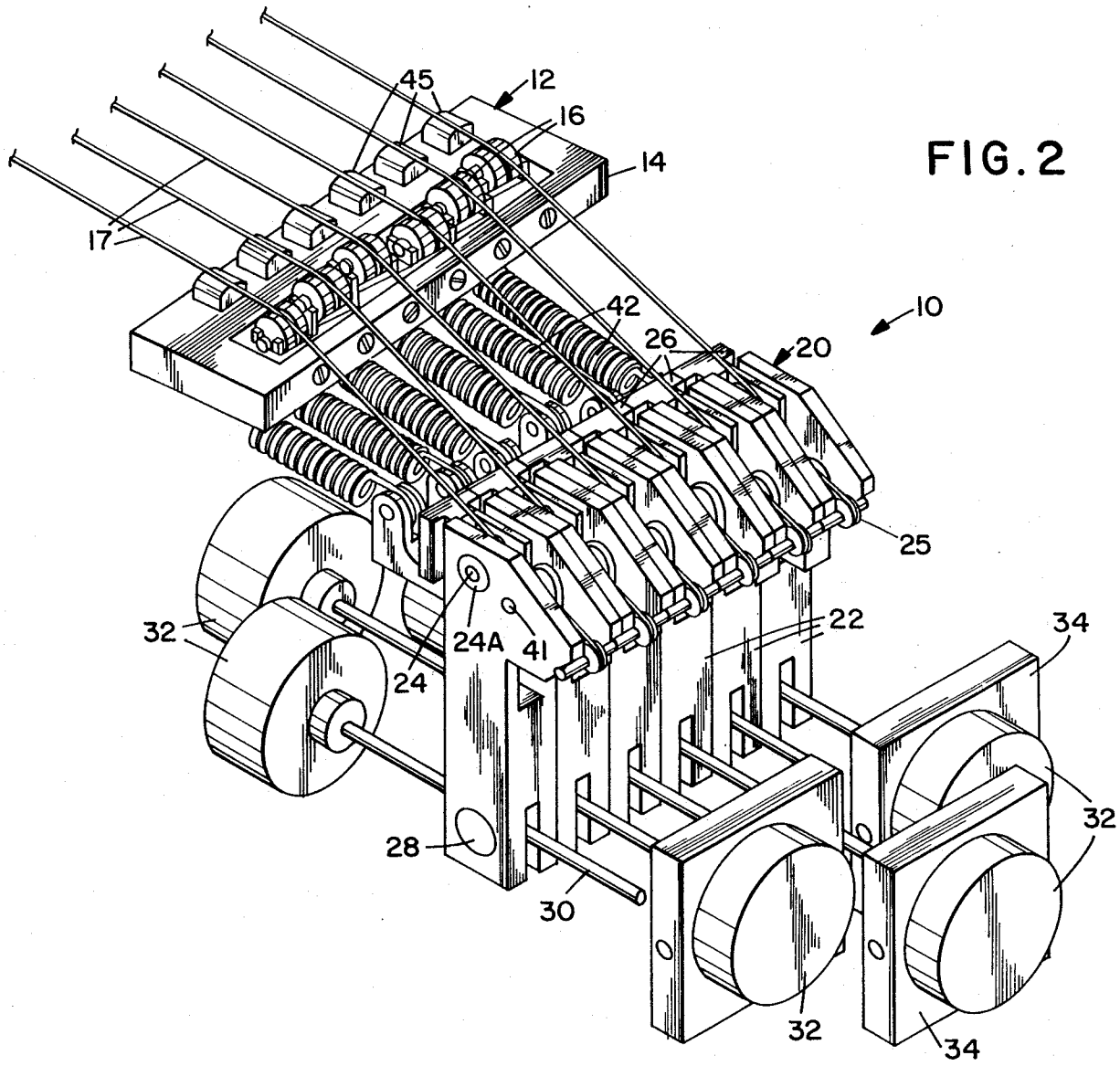
FIG. 2 is an isometric drawing illustrating one embodiment of an automatic tuning assembly of this invention as incorporated into a six-string guitar.
Figure 3:
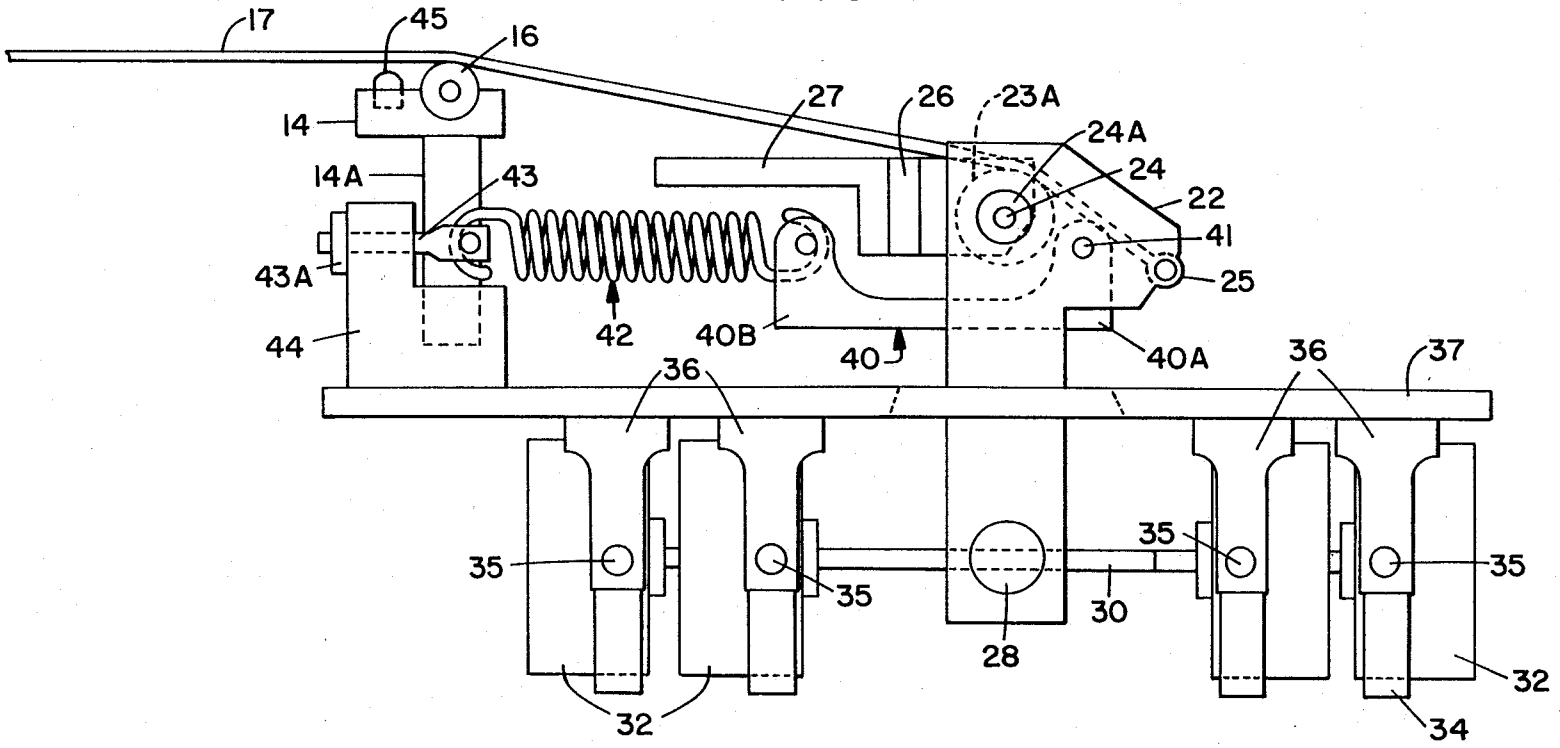
FIG. 3 is a side view of the tuning assembly shown in FIG. 2.
Figure 4:
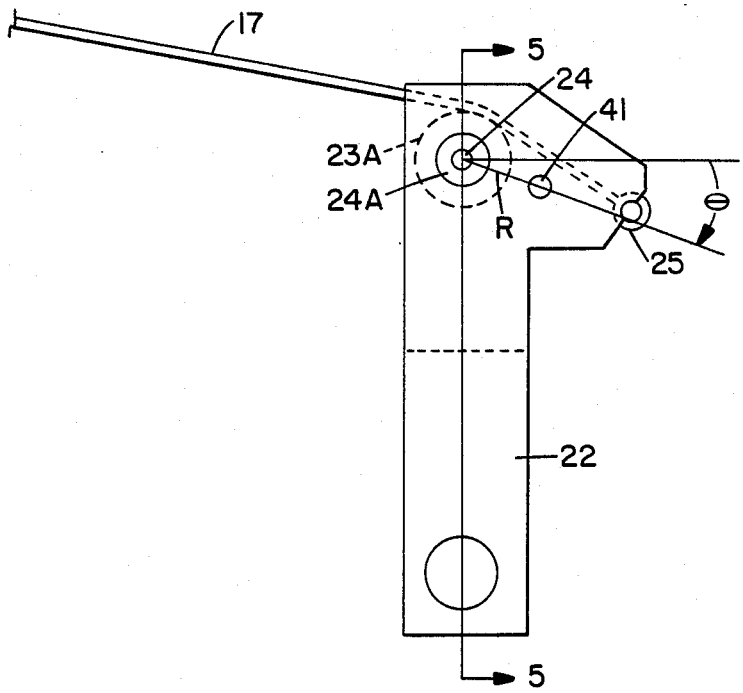
FIG. 4 is a side elevational view of a tuning lever useful in the system of this invention.
Figure 5:
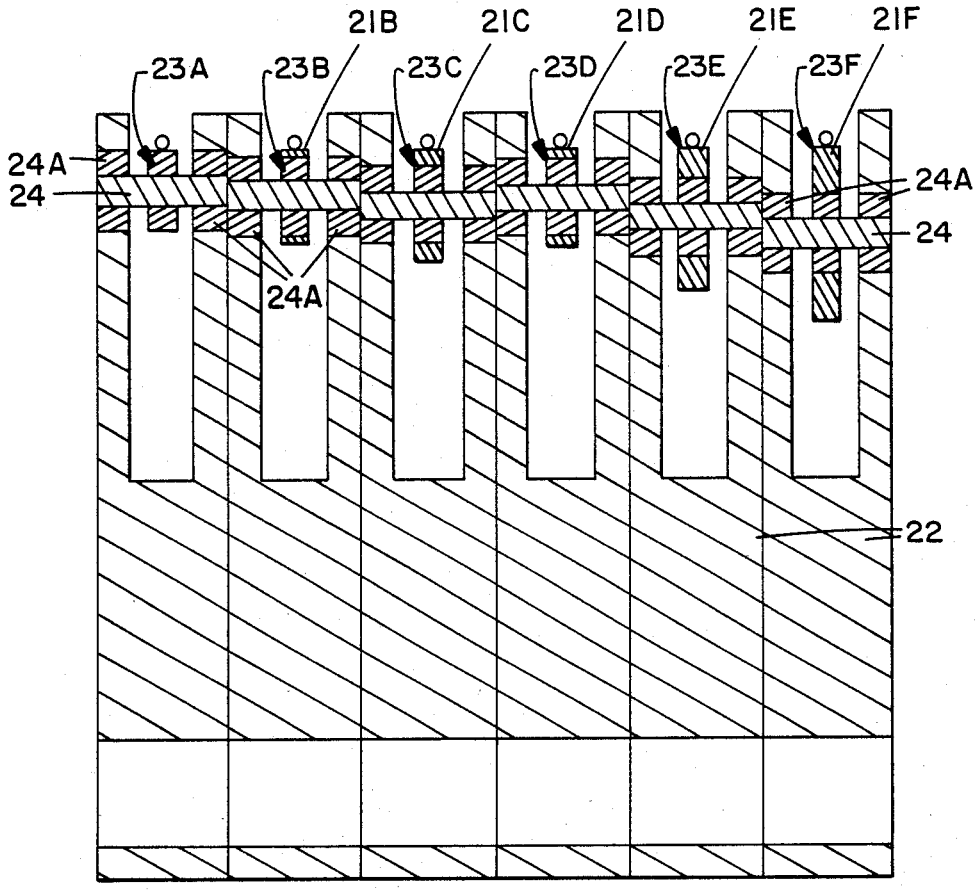
FIG. 5 is a cross-sectional view of the tune lever assembly shown in FIGS. 2 and 3, taken along vertical plane passing through each tune lever arm.

The correction is in the form of the number of steps and the direction of rotation to be delivered to a stepper motor. The shaft of the stepper motor is connected to a tune lever for the string via a threaded teflon nut 28. A preferred system is shown in FIGS. 2, 3 and 4. A cross-sectional view of the tune lever assembly is shown in FIG. 5.

ELECTROMECHANICAL STRING ADJUSTMENT

Thus, there is shown an electromechanical system 10 for incorporation into a guitar for selective adjustment of the tension of the separate strings to adjust the frequency thereof. Bridge assembly 12 is secured to the main body of the electromechanical system 10 at bracket 44 in such a way that it occupies the normal bridge position on the guitar when the electromechanical system is mounted in the guitar body. This assembly includes base 14 which carries several individual rollers 16. The height of base 14 is adjusted relative to the face of the guitar using bridge height adjustment screw 14A. Each roller supports a single string 17 of the guitar at the tail end. The rollers 16 rotate freely so as to impart minimal friction to movement of the strings as they are tightened or loosened. Base 14 also supports the magnetic pickups 45 positioned under the strings 17, as illustrated.

Tail piece or tune lever assembly 20 is secured in a recessed area in the guitar. Assembly 20 comprises a plurality of individual tune lever arms 22 pivotably supported on individual shafts or axles 24 extending transversely through the upper end of respective tune lever arms 22. A separate fork-shaped support element 26 supports each individual axle 24 for each tune lever arm 22. All of the support elements 26 are fastened securely to L-shaped support member 27 (shown in FIG. 3) which is adapted to be fastened to the guitar base.

The upper end of each lever arm 22 includes a free rotating inside roller 23A, 23B, 23C, 23D, 23E and 23F, respectively, as shown in FIG. 5. A string 17 extends over each such roller. Sleeves 21B, 21C, 21D, 21E and 21F are disposed around rollers 23B through 23F, respectively, and have different diameters and pivot points such that the string contact point of all rollers are in the same plane. This allows similar angular movement of each lever 22 to move each string a different linear distance to produce similar musical changes in the frequencies generated by the strings. The position of each axle 24 in a respective tune lever arm varies according to the radius of each sleeve member used on each such roller.

To reduce friction at the upper end of each tune lever, miniature ball bearings 24A support each end of each axle or shaft 24, as illustrated.

To lower end of each lever arm 22 includes a threaded pivot pin or nut 28 which is adapted to engage a threaded shaft 30 controlled by stepper motor 32. A mounting plate 34 is secured to each stepper motor and serves as a means for mounting each motor to a hanger mount 36 with pins 35 in the recessed area of the guitar in a manner such that the motor can pivot slightly. Each mount 36 is fastened to plate 37. The end of each string 17 is secured to or captured by holder 25 on each lever arm 22. Motor 32 and associated shaft or lead screw 30 are mounted in a hanger 36 with pin 35 at the center of mass of the motor to reduce orientational problems with the motor and lead screw operation as the instrument is played.

A link member 40 is connected at one end 40A to the upper portion of tune lever arm 22 by means of pin 41. The opposite end 40B of link 40 is connected to a coiled spring 42 which in turn is attached to threaded bolt or fastener 43 carried by anchor or bracket 44. The tension provided by spring 42 may be adjusted by means of nut 43A on bolt 43.

The effect of the coiled spring 42 (or other equivalent bias means) and link member 40 is to counter-balance the moment produced by string 17 by urging tune lever arm 22 to pivot relative to axle 24. This reduces the load on each stepper motor 32. As a result, the size and power of each stepper motor may be smaller than would otherwise be required.

FIG. 4 shows that the location of the spring anchor 41 relative to the tune lever pivot point 24 varies on each arm. The location of the spring anchor point is dimensioned using the angle "theta" and the radius "R" (which is the distance between the center of pivot 24 to the center of anchor 41). By computing the force and distance characteristics of each string the spring anchor 41 is located so as to maximally cancel the moment produced by said string on the lever arm 22.

Thus, upon receipt of an electrical signal from the computer, each stepper motor rotates a corresponding shaft 30 in order to pivot a lever arm 22. This causes the corresponding string 17 to be either loosened or tightened, as required, to adjust it to the desired frequency.

Because a general purpose computer system is used in the decision making process, information regarding such things as the interaction among the strings as they are tuned can be included. An example of this is the "neck bowing" caused by the change in tension of the string being tuned. This causes a change in the tension of strings not being tuned resulting in an unwanted change in their frequencies. These kinds of interactions are all well documented in the musical literature to the extent that many have complete equations describing their effects. Utilizing this information, the movement of all the strings to their correct frequencies can be done all at once rather than the more lengthy "trial and error" procedure used previously.

To eliminate detailed consideration of these and other algorithms, the system will "calibrate" the guitar before each playing by allowing the computer system to measure all the effects possible. One could use a small, computer controlled "strummer" allowing the computer to automatically go through a series of tests by setting up the data acquisition, actuating the "strummer", collecting the data, updating its total algorithm, then looping through the analysis until the calibration process is complete. Following this, the "tuning" of the guitar could be changed to any predetermined state using the calibration algorithm without further need of recalibration. Examples are the "open" tunings, tempered tuning, just tuning in musical pitch, and varying the pitch of any of these tuning modes by four half steps up or down during the playing of a song.

The connection to the stepper motors is a very simple digital pulse interface common to most computers. When the system determines the correct number of steps for each motor, these steps are sent as transistor-transistor logic (TTL) level pulses over the digital lines to each motor using standard TTL techniques. The system may include means for first "loading" a pulse count into all motor controllers followed by a "go" command such that all motors move in unison.

CALIBRATION

System calibration is achieved using standard mathematical techniques in linear algebra and statistics including curvilinear regression and matrix diagonalization.

First, a data set is acquired which represents the interactions among all motors, all strings, and all linear and non-linear contributions to tuning in the system. Such a data set is accumulated in the following manner: All six motors are moved to one end of their respective ranges. The frequencies of all six strings are recorded as well as the positions of the six motors. Then one motor is moved half way along its range while the other five remain constant. The six frequencies and motor positions are again recorded. A second move of this same motor to its full range is recorded in similar fashion. Then the other five motors are moved and the data recorded in the same way.

The data set then contains enough information to characterize the relationships among all frequencies (tensions) of all the strings. The frequency of each string has been recorded for three motor positions (string tensions) of each string while all other motors remain fixed.

This is enough data to determine a second order relationship amongst motor positions and frequencies for all strings. Standard curvilinear regression is done on the data set producing six equations, one for the position of each motor as a function of all six string frequencies and their squares. It then becomes a simple matter for the computer system to insert the frequencies for each of the six strings associated with a certain tuning into the system of equations from which the six motor positions are then derived.

It can then readily be seen that even when only one of the six frequencies is changed in this way, a significant motor movement is produced on all strings, a large movement for the string whose frequency is changing and smaller, yet non-zero changes on the other strings. These smaller changes on the strings whose frequencies are not changing are the "corrections" the system calculates to counteract the effect of changing one string's frequency while the others remain constant. These corrections constitute a major component of the non-linear compensation this system provides in automatically tuning a musical instrument.

When the musician discovers that his instrument is no longer in tune following a period of use since the last calibration, a "touch-up" operation should be all that is necessary to bring the system back into calibration. This assumes that the changes predicted by the first and second order terms in frequency for each motor still apply and that all predictions for motor position are off by a constant. To "touch-up" the calibration, a single data set of six frequencies and six motor positions is determined anywhere in the range of the system. This data set is then used to adjust the constant terms in each motor equation. In practice, this has worked quite well. Seldom will a complete recalibration be necessary even when strings are changed unless the new strings are significantly different from the old strings (i.e., unless the new strings differ in cross-section or in composition).

Other variants are possible without departing from the scope of this invention.

What is claimed is:

1. A system for automatically tuning a stringed musical instrument by changing the frequency of a musical tone produced by each string of said instrument; said system comprising:

(a) a detection means adapted to detect a musical tone produced by said instrument and produce a signal;

(b) converter means adapted to convert said signal to a digital signal;

(c) processing means adapted to convert said digital signal to a frequency signal;

(d) comparator means for comparing said frequency signal to a predetermined frequency value and producing an electrical signal;

(e) tension adjustment means comprising a pivotable tune lever arm means connected to said string for adjusting the tension on said string;

(f) motor means activated by said electrical signal; wherein said motor means is operably connected to said adjustment means for adjusting said frequency to correspond with said predetermined value; and (g) bias means connected to said tension adjustment means for providing a bias force in opposition to the force exerted on said tension adjustment means by said string.

2. A tuning system in accordance with claim 1, wherein said instrument includes a plurality of strings; wherein said adjustment means comprises a plurality of pivotable tune lever arms corresponding to the number of said strings to be tuned; wherein there are a plurality of said detection means corresponding to the number of said strings to be tuned; wherein there are a plurality of said motor means, each of which is operably connected to a said tune lever arm; and wherein all said strings to be tuned are tuned simultaneously.

3. A tuning system in accordance with claim 2, wherein said instrument is a guitar; and wherein said motor means comprises a stepper motor.

4. A tuning system in accordance with claim 1, wherein said detection means comprises a magnetic pickup.

5. A tuning system in accordance with claim 1, wherein said detection means comprises a transducer.

6. A tuning system in accordance with claim 1, wherein said processing means for converting said digital signal to a frequency signal includes the use of a time-to-frequency domain transformation algorithm.

7. A tuning system in accordance with claim 1, wherein said detection means comprises magnetic pole members defining a gap therebetween adjacent said string, an electric coil in operative association with one of said pole members, and a source of D.C. voltage connected to said coil, whereby a static magnetic field is created across said gap.

8. A tuning system in accordance with claim 3, further comprising compensating means for compensating for non-linear effects of said instrument.

9. A tuning system in accordance with claim 1, wherein said bias means provides a said bias force which counterbalances the force exerted on said tension adjustment means by said string.

10. A tuning system in accordance with claim 1, wherein said bias means comprises a coiled spring.

11. A tuning system in accordance with claim 1, further comprising calibration means for computing the relationship between said frequency signal and the tension on said string.

12. A tuning system for automatically tuning a musical instrument having a plurality of strings, said instrument comprising:

(a) detection means adapted to detect a musical tone produced by each said string and produce a signal corresponding to each said tone;

(b) converter means adapted to convert each said signal to a digital signal;

(c) processing means adapted to convert each said digital signal to a frequency signal;

(d) comparator means for comparing each said frequency signal to a separate predetermined frequency value and producing an electrical signal corresponding to the difference between said frequency signal and said predetermined frequency value;

(e) tension adjustment means comprising a plurality of pivotable tune lever arms each of which is connected to a separate one of said strings for adjusting the tension on a said string;

(f) a plurality of motors each of which is activated by a said electrical signal; wherein each said motor is operably connected to a said tune lever arm for adjusting the frequency of a said string to correspond with said predetermined frequency value;

(g) a plurality of bias means each of which is connected to a said tune lever arm for providing a bias force in opposition to the force exerted on said tune lever arm by a said string; and (h) calibration means for computing the relationship between said frequency signal and the tension on said string.

13. A tuning system in accordance with claim 12, wherein said instrument is a guitar; and wherein said detection means comprises a magnetic pickup.

14. A tuning system in accordance with claim 12, wherein said detection means comprises a transducer.

15. A tuning system in accordance with claim 12, wherein said processing means for converting said digital signal to a frequency signal includes the use of a fast Fourier transform.

16. A tuning system in accordance with claim 12, further comprising compensating means for compensating for non-linear effects of said instrument.

17. A tuning system in accordance with claim 12, wherein each said bias means provides a said bias force which counterbalances the force exerted on a said tune lever arm by a said string; and wherein each said bias means comprises a coiled spring.

18. A system for automatically tuning a stringed instrument by changing the frequency of a musical tone produced by each string of said instrument; said system comprising:

(a) a detection means adapted to detect a musical tone produced by said instrument and produce a signal;

(b) converter means adapted to convert said signal to a digital signal;

(c) processing means adapted to convert said digital signal to a frequency signal;

(d) comparator means for comparing said frequency signal to a predetermined frequency value and producing an electrical signal;

(e) tension adjustment means comprising a pivotable tune lever arm means connected to said string for adjusting the tension on said string;

(f) motor means activated by said electrical signal; wherein said motor means is operably connected to said adjustment means for adjusting said frequency to correspond with said predetermined value; and (g) calibration means for computing the relationship between said frequency signal and the tension on said string.

* * * * *

UNITED STATES PATENT AND TRADEMARK OFFICE
Certificate

Patent No. 4,909,126 Patented: March 20, 1990

On petition requesting issuance of a certificate for correction of inventorship pursuant to 35 U.S.C. 256, it has been found that the above-identified patent, through error, and without any deceptive intent, improperly sets forth the inventorship.

Accordingly, it is hereby certified that the correct inventorship of this patent is: Neil C. Skinn, Stephen J. Freeland and Frederick A. Skinn.

Signed and Sealed this Second Day of September, 1997.

MICHAEL L. GELLNER
*Supervisory Patent Examiner*
Patent Examining Art Unit 2100